US011282374B2

(12) United States Patent
Beale et al.

(10) Patent No.: US 11,282,374 B2
(45) Date of Patent: Mar. 22, 2022

(54) SYSTEMS AND METHODS FOR BUILDING AND USING A FALSE ALARM PREDICTING MODEL TO DETERMINE WHETHER TO ALERT A USER AND/OR RELEVANT AUTHORITIES ABOUT AN ALARM SIGNAL FROM A SECURITY SYSTEM

(71) Applicant: Ademco Inc., Golden Valley, MN (US)

(72) Inventors: Brian Beale, Woodbury, MN (US); Sharath Venkatesha, Minnetonka, MN (US); Soumitri Kolavennu, Blaine, MN (US); Nathaniel Kraft, Minnetonka, MN (US)

(73) Assignee: Ademco Inc., Golden Valley, MN (US)

( * ) Notice: Subject to any disclaimer, the term of this patent is extended or adjusted under 35 U.S.C. 154(b) by 48 days.

(21) Appl. No.: 16/942,709

(22) Filed: Jul. 29, 2020

(65) Prior Publication Data

US 2021/0056836 A1 Feb. 25, 2021

Related U.S. Application Data

(63) Continuation of application No. 16/543,786, filed on Aug. 19, 2019, now Pat. No. 10,762,773.

(51) Int. Cl.
*G08B 29/00* (2006.01)
*G08B 29/18* (2006.01)
(Continued)

(52) U.S. Cl.
CPC ..... *G08B 29/188* (2013.01); *G08B 23/00* (2013.01); *G08B 25/001* (2013.01); *G08B 29/02* (2013.01); *G08B 29/26* (2013.01)

(58) Field of Classification Search
CPC .... G08B 29/188; G08B 25/001; G08B 23/00; G08B 29/02; G08B 29/26; G08B 25/14; G08B 29/186; G08B 31/00
See application file for complete search history.

(56) References Cited

U.S. PATENT DOCUMENTS 4,191,953 A 3/1980 Woode
4,527,151 A 7/1985 Byrne
(Continued)

FOREIGN PATENT DOCUMENTS

CA 2351138 A1 12/2002
CN 1501043 A 6/2004
(Continued)

OTHER PUBLICATIONS

Stanley, "SU 100 Motion Sensor", dated 2000, 2 pgs.
(Continued)

*Primary Examiner* — Toan N Pham
(74) *Attorney, Agent, or Firm* — Fredrikson & Byron, P.A.

(57) ABSTRACT

Systems and methods for building and using a false alarm predicting model to determine whether to alert a user and/or relevant authorities about an alarm signal from a security system are provided. Such systems and methods can include a learning module receiving the alarm signal and additional information associated with the alarm signal, using the false alarm predicting model to process a combination of the alarm signal and the additional information to determine whether the combination represents a false alarm or a valid alarm, and transmitting a status signal indicative of whether the combination represents the false alarm or the valid alarm to an automated dispatcher module, and the automated dispatcher module using the status signal to automatically determine whether to alert the user and/or the relevant authorities about the alarm signal.

20 Claims, 6 Drawing Sheets

(51) Int. Cl.

| | |
|---|---|
| ***G08B 25/00*** | (2006.01) |
| ***G08B 23/00*** | (2006.01) |
| ***G08B 29/02*** | (2006.01) |
| ***G08B 29/26*** | (2006.01) |

(56) References Cited

U.S. PATENT DOCUMENTS

| | | | | |
|---|---|---|---|---|
| 4,551,711 | A | 11/1985 | Akiyama et al. | |
| 5,026,990 | A | 6/1991 | Marman et al. | |
| 5,276,427 | A | 1/1994 | Peterson | |
| 5,287,111 | A | 2/1994 | Shpater | |
| 5,331,308 | A | 7/1994 | Buccola et al. | |
| 5,758,324 | A | 5/1998 | Hailman et al. | |
| 5,781,108 | A | 7/1998 | Jacob et al. | |
| 5,966,090 | A | 10/1999 | Mcewan | |
| 5,986,357 | A | 11/1999 | Myron et al. | |
| 6,353,385 | B1 | 3/2002 | Molini et al. | |
| 6,377,174 | B1 | 4/2002 | Siegwart et al. | |
| 6,624,750 | B1 | 9/2003 | Marman et al. | |
| 6,778,092 | B2 | 8/2004 | Braune | |
| 6,943,685 | B2 | 9/2005 | Seo | |
| 6,946,959 | B2 | 9/2005 | Wang | |
| 6,992,577 | B2 | 1/2006 | Tsuji et al. | |
| 7,042,349 | B2 | 5/2006 | Bergman et al. | |
| 7,079,030 | B2 | 7/2006 | Tsuji | |
| 7,084,761 | B2 | 8/2006 | Izumi et al. | |
| 7,274,387 | B2 | 9/2007 | Gupta et al. | |
| 7,327,253 | B2 | 2/2008 | Whitten et al. | |
| 7,463,182 | B1 | 12/2008 | Morinaga et al. | |
| 7,617,327 | B1 | 11/2009 | Allam et al. | |
| 7,636,039 | B2 | 12/2009 | Babich | |
| 7,679,509 | B2 | 3/2010 | Royer | |
| 7,796,033 | B2 | 9/2010 | Green et al. | |
| 7,873,868 | B1 | 1/2011 | Heideman et al. | |
| 8,102,261 | B2 | 1/2012 | Wu | |
| 8,179,256 | B2 | 5/2012 | Crisp et al. | |
| 8,432,448 | B2 | 4/2013 | Hassapis et al. | |
| 8,509,815 | B1 | 8/2013 | Shojayi et al. | |
| 8,519,883 | B2 | 8/2013 | Drake et al. | |
| 8,565,125 | B2 | 10/2013 | Blum et al. | |
| 8,626,210 | B2 | 1/2014 | Hicks, III | |
| 9,013,294 | B1 | 4/2015 | Trundle | |
| 9,125,144 | B1 | 9/2015 | Orbach et al. | |
| 9,189,751 | B2 | 11/2015 | Matsuoka et al. | |
| 9,224,285 | B1 | 12/2015 | Trundle | |
| 9,237,315 | B2 | 1/2016 | Naylor et al. | |
| 9,384,656 | B2 * | 7/2016 | Patterson | G08B 25/08 |
| 9,498,885 | B2 | 11/2016 | Scott et al. | |
| 9,633,547 | B2 * | 4/2017 | Farrand | G08B 25/08 |
| 9,655,217 | B2 | 5/2017 | Recker et al. | |
| 9,786,158 | B2 | 10/2017 | Beaver et al. | |
| 9,940,797 | B2 | 4/2018 | Lamb et al. | |
| 10,147,307 | B2 | 12/2018 | Patterson et al. | |
| 10,176,706 | B2 | 1/2019 | Beaver et al. | |
| 10,380,521 | B2 | 8/2019 | Kapuschat et al. | |
| 10,930,122 | B1 * | 2/2021 | Zakaria | G08B 29/126 |
| 2002/0175815 | A1 | 11/2002 | Baldwin | |
| 2003/0030557 | A1 | 2/2003 | Progovac et al. | |
| 2004/0113778 | A1 | 6/2004 | Script et al. | |
| 2004/0119778 | A1 | 6/2004 | Naito | |
| 2005/0030179 | A1 | 2/2005 | Script et al. | |
| 2005/0128067 | A1 | 6/2005 | Zakrewski | |
| 2005/0203647 | A1 | 9/2005 | Landry et al. | |
| 2005/0207105 | A1 | 9/2005 | Davies | |
| 2006/0073822 | A1 | 4/2006 | Orton et al. | |
| 2006/0103520 | A1 | 5/2006 | Clark | |
| 2006/0125621 | A1 | 6/2006 | Babich | |
| 2006/0139164 | A1 | 6/2006 | Tsuji | |
| 2006/0266944 | A1 | 11/2006 | Chi et al. | |
| 2007/0018106 | A1 | 1/2007 | Zhevelev et al. | |
| 2007/0115164 | A1 | 5/2007 | Wu et al. | |
| 2007/0176765 | A1 | 8/2007 | Babich et al. | |
| 2007/0210909 | A1 | 9/2007 | Addy | |
| 2007/0252720 | A1 | 11/2007 | Hughes et al. | |
| 2007/0253461 | A1 | 11/2007 | Billington et al. | |
| 2008/0084292 | A1 | 4/2008 | Dipoala | |
| 2008/0100498 | A1 | 5/2008 | Fullerton et al. | |
| 2008/0184059 | A1 | 7/2008 | Chen | |
| 2008/0204190 | A1 | 8/2008 | Cohn et al. | |
| 2008/0218339 | A1 | 9/2008 | Royer | |
| 2008/0218340 | A1 | 9/2008 | Royer | |
| 2008/0310254 | A1 | 12/2008 | Piel et al. | |
| 2008/0316025 | A1 | 12/2008 | Cobbinah et al. | |
| 2008/0316309 | A1 | 12/2008 | Roper | |
| 2009/0051529 | A1 | 2/2009 | Tsuji | |
| 2009/0079563 | A1 | 3/2009 | Tsuji | |
| 2009/0167538 | A1 | 7/2009 | Merritt et al. | |
| 2009/0240974 | A1 | 9/2009 | Baba et al. | |
| 2009/0273463 | A1 | 11/2009 | Morwood et al. | |
| 2009/0322527 | A1 | 12/2009 | Crisp et al. | |
| 2010/0013636 | A1 | 1/2010 | Wu | |
| 2010/0045471 | A1 | 2/2010 | Meyers | |
| 2010/0201527 | A1 | 8/2010 | Jensen et al. | |
| 2010/0201787 | A1 | 8/2010 | Zehavi | |
| 2010/0242084 | A1 | 9/2010 | Keeni | |
| 2010/0271198 | A1 | 10/2010 | Boling et al. | |
| 2010/0277300 | A1 | 11/2010 | Cohn et al. | |
| 2010/0313064 | A1 | 12/2010 | Boctor et al. | |
| 2010/0328056 | A1 | 12/2010 | Merkel et al. | |
| 2011/0046698 | A1 | 2/2011 | Kivi et al. | |
| 2011/0047253 | A1 | 2/2011 | Bhat | |
| 2011/0065414 | A1 | 3/2011 | Frenette et al. | |
| 2011/0102171 | A1 | 5/2011 | Raji et al. | |
| 2011/0143774 | A1 | 6/2011 | Mcnamara et al. | |
| 2011/0169628 | A1 | 7/2011 | Elliot et al. | |
| 2011/0254681 | A1 | 10/2011 | Perkinson et al. | |
| 2011/0261680 | A1 | 10/2011 | Boudreaux et al. | |
| 2012/0013739 | A1 | 1/2012 | Peterson et al. | |
| 2012/0047494 | A1 | 2/2012 | Unrein et al. | |
| 2012/0139718 | A1 | 6/2012 | Foisy et al. | |
| 2012/0154138 | A1 | 6/2012 | Cohn et al. | |
| 2012/0161976 | A1 | 6/2012 | Xie et al. | |
| 2012/0188072 | A1 | 7/2012 | Dawes et al. | |
| 2012/0188081 | A1 | 7/2012 | Van Katwijk | |
| 2012/0319842 | A1 | 12/2012 | Amis | |
| 2013/0113397 | A1 | 5/2013 | Salter et al. | |
| 2013/0179625 | A1 | 7/2013 | Stanton et al. | |
| 2013/0189946 | A1 | 7/2013 | Swanson | |
| 2013/0240739 | A1 | 9/2013 | Shpater | |
| 2013/0246850 | A1 | 9/2013 | Getter et al. | |
| 2013/0249688 | A1 | 9/2013 | Nguyen et al. | |
| 2013/0285799 | A1 | 10/2013 | Probin et al. | |
| 2013/0300566 | A1 | 11/2013 | Kumfer et al. | |
| 2014/0266699 | A1 | 9/2014 | Poder et al. | |
| 2014/0359101 | A1 | 12/2014 | Dawes et al. | |
| 2015/0061859 | A1 | 3/2015 | Matsuoka et al. | |
| 2015/0070205 | A1 | 3/2015 | Chang et al. | |
| 2015/0212205 | A1 | 7/2015 | Shpater | |
| 2015/0309167 | A1 | 10/2015 | Shikatani et al. | |
| 2015/0369618 | A1 | 12/2015 | Barnard et al. | |
| 2016/0226892 | A1 | 8/2016 | Sen et al. | |
| 2016/0240056 | A1 | 8/2016 | Chen | |
| 2017/0103648 | A1 | 4/2017 | Bodurka | |
| 2017/0108885 | A1 | 4/2017 | Meganathan et al. | |
| 2017/0206771 | A1 | 7/2017 | Hermann | |
| 2018/0159593 | A1 | 6/2018 | Bogdan et al. | |
| 2019/0086266 | A1 | 3/2019 | Lin et al. | |
| 2020/0250945 | A1 | 8/2020 | Liiv et al. | |

FOREIGN PATENT DOCUMENTS

| | | | |
|---|---|---|---|
| CN | 1612542 | A | 5/2005 |
| CN | 101446965 | A | 6/2009 |
| DE | 202011004996 | U1 | 3/2012 |
| EP | 2260563 | B1 | 10/2011 |
| EP | 3355289 | A1 | 8/2018 |
| ES | 1006935 | U | 1/1989 |
| GB | 2078413 | A | 1/1982 |
| JP | 2000338231 | A | 12/2000 |
| JP | 2003317178 | A | 11/2003 |
| JP | 2011028574 | A | 2/2011 |

(56) References Cited

FOREIGN PATENT DOCUMENTS

| | | | |
|---|---|---|---|
| KR | 20060073055 | A | 6/2006 |
| WO | WO 2016/109838 | A1 | 7/2016 |

OTHER PUBLICATIONS

"How Terminal Services Works," Technet.microsoft.com, Updated Mar. 28, 2003, downloaded from http://technet.microsoft.com/en-us/library/cc755399(d-printer,v=ws.1 0).aspx on Nov. 5, 2014, 10 pgs.
Rytec Corporation "Motion Detector—Installation and Operating Instructions", Revision: Jan. 21, 2003, 10 pgs.
Mark Kretschmar, Lion Precision Sensors, "Capacitive Sensor Operation Part 1: The Basics", May 1, 2009, 6 pgs.
Mark Kretschmar, Lion Precision Sensors, "Capacitive Sensor Operation Part 2: System Optimization", Jun. 1, 2009, 5 pgs.
Thomas Perme et al., "Capacitive Touch Using Only an ADC ("CVD") AN1298", Microchip Technology Inc., DS01298A, Mar. 26, 2009, 4 pgs.
Atmel, "Proximity Design Guide, Application Note QTAN0087", 10760A-AT42, Nov. 2011, 12 pgs.
Atmel, "QTouch 12-channel Touch Sensor IC, AT42QT2120 [Preliminary]", 9634AX-AT42, Nov. 2011, 42 pgs.
"Atmel Delivers QTouch Capacitive Touch Controller", downloaded from http://sensorsmag.com/electronics-computers/news/atmel-delivers-qtouch-capacitive-touch-control . . . on Nov. 16, 2011, 2 pgs.
Cypress Semiconductor Corporation, "Cypress Perform, PSoC Programmable System-on-Chip", Document No. 001-67345, Rev. *A, Revised May 13, 2011, 47 pgs.
Cypress Semiconductor, "Cypress Perform, CY3235-ProxDet, CapSense Proximity Detection Demonstration Kit Guide", Doc. #: 001-67986 Rev. *B, Oct. 14, 2011, 34 pgs.
NXP Semiconductors, "PCA8886—Dual channel capacitive proximity switch with auto-calibration and large voltage operating range", Rev. 1—Nov. 23, 2011, 26 pgs.
United States Nuclear Regulatory Commission, Office of Nuclear Security and Incident Response, "Intrusion Detection Systems and Subsystems", Technical Information for NRG Licensees, Published Mar. 2011, 208 pgs.
Semtech Launches Smart Proximity Sensor, downloaded from http://sensorsmag.com/electronice-computers/consumer/news/semtech-launches-smart-proximity-sensor-10190?print=1, dated Jun. 25, 2012, 3 pgs.
Honeywell Intrusion and Communications—AlarmNet Services, http://www.security.honeywell.com/hsc/solutions/alarmnet/index.html, downloaded on Mar. 11, 2013, 2 pgs.
Honeywell Security and Communications UK, C081 DCM, downloaded from http://www.security.honeywell.com1uk/intruder/products/co/gxacc/ac/213273.html on Mar. 11, 2013, 1 pg.
Honeywell Intrusion and Communications—iGSMV, downloaded from http://www.security. honeywell .com/hsc/prod ucts/alarm/re/gsm/304824.html on Mar. 11, 2013, 3 pgs.
Honeywell Intrusion and Communications—7845GSM, downloaded from http://www.security.honeywell.com/canada/products/alann/re/gsm/103665.html on Mar. 11, 2013, 2 pgs.
Essential Video Analytics 6.30, Bosch Security Systems 2017, V3, Feb. 16, 2017, 3 pgs.
T.K. Hareendran, HB100 Microwave Motion Sensor—An Introduction, Electro Schematics, downloaded from http://electroschematics.com/11926/hb100-microwave-mot . . . on Aug. 14, 2017, 5 pgs.
Honeywell Galaxy Dimension, Integrated Intrusion and door control panel range, dated Oct. 2012, 3 pgs.
Partial Search Report for European Patent Application No. 20178346.1 dated Nov. 11, 2020, 14 pgs.

* cited by examiner

SYSTEMS AND METHODS FOR BUILDING AND USING A FALSE ALARM PREDICTING MODEL TO DETERMINE WHETHER TO ALERT A USER AND/OR RELEVANT AUTHORITIES ABOUT AN ALARM SIGNAL FROM A SECURITY SYSTEM

CROSS-REFERENCE TO RELATED APPLICATIONS

This application is a continuation of and claims the benefit of the filing date of U.S. application Ser. No. 16/543,786 filed Aug. 19, 2019.

FIELD

The present invention relates generally to security systems. More particularly, the present invention relates to systems and methods for building and using a false alarm predicting model to determine whether to alert a user and/or relevant authorities about an alarm signal from a security system.

BACKGROUND

Known security systems utilize a cloud server to process alarm signals and distribute the alarm signals to a central monitoring station for review and transmission of alert signals to users and/or relevant authorities when needed. However, known security systems often produce a high number of false alarms that consume bandwidth when transmitted and must be screened by live technicians at the central monitoring station, thereby greatly increasing costs associated with operating the central monitoring station.

For example, when the cloud server receives an alarm signal from a security system, the cloud server identifies the central monitoring station associated with the security system and transmits an unfiltered version of the alarm signal to the central monitoring station. Then, the central monitoring station processes the alarm signal by placing the alarm signal in a queue and retrieving associated customer information. When an operator becomes available, the central monitoring station removes the alarm signal and the associated customer information from the queue and presents the alarm signal and the associated customer information to the operator for review. In an attempt to identify any false alarms, the operator may contact a user of the security system via a primary phone number and/or a backup phone number to solicit user input indicative of whether the alarm signal is a valid alarm. Then, the operator will contact the relevant authorities when he or she confirms that the alarm signal likely corresponds to the valid alarm or fails to confirm that the alarm signal corresponds to a false alarm.

Unfortunately, the above-described systems and methods consume more bandwidth than is necessary for valid alarms and a lot of time that the operator could otherwise spend addressing the alarm signals known to be valid. Therefore, there is a need and an opportunity for improved systems and methods.

DETAILED DESCRIPTION

Figure 1:
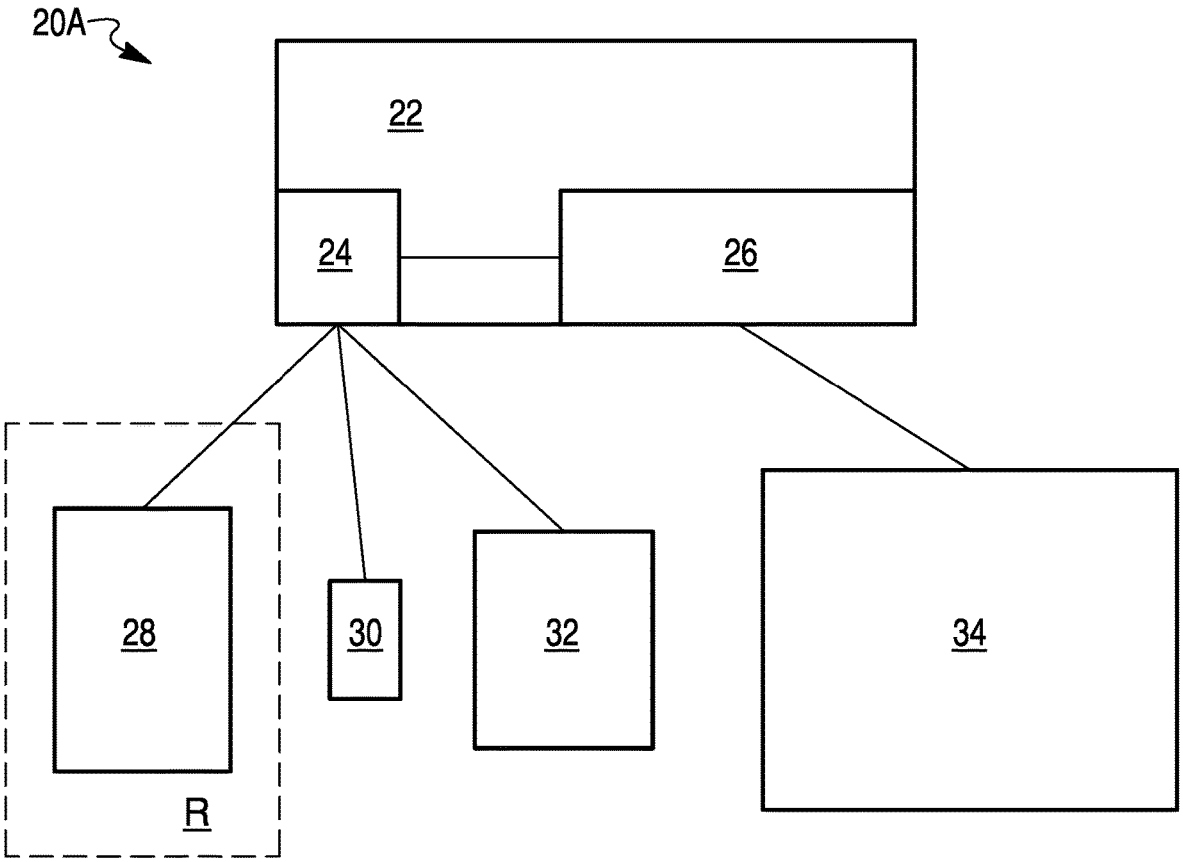
FIG. 1 is a block diagram of a system in accordance with disclosed embodiments.

While this invention is susceptible of an embodiment in many different forms, specific embodiments thereof will be described herein in detail with the understanding that the present disclosure is to be considered as an exemplification of the principles of the invention. It is not intended to limit the invention to the specific illustrated embodiments.

Embodiments disclosed herein can include systems and methods that use artificial intelligence and machine learning to determine what security actions to execute and when to execute those security actions responsive to an alarm signal from a security system by fusing security system sensor data, situational awareness/contextual data, user preference data, and the like. For example, systems and methods disclosed herein can determine whether to push a security notification to a mobile application of a user, call or refrain from calling the user via a primary phone number and/or a backup phone number, and/or call or dispatch relevant authorities to a secured area.

In accordance with disclosed embodiments, systems and methods disclosed herein can build and use a false alarm predicting model to process alarm signals from the security system to (1) maximize a likelihood that false alarms are identified before otherwise being transmitted to the user and/or the relevant authorities and (2) enable use of an automated dispatcher module to directly report the alarm signals to the user and/or the relevant authorities. For example, a learning module can use the false alarm predicting model to process an alarm signal from the security system and, responsive thereto, generate a status signal. The automated dispatcher module can process the status signal to automatically determine whether to alert the user and/or the relevant authorities about the alarm signal.

In some embodiments, the false alarm predicting model can be managed by the learning module. For example, in some embodiments, the learning module can receive the alarm signal from the security system and additional information associated with the alarm signal, use the false alarm predicting model to process a combination of the alarm signal and the additional information to determine whether the combination represents a false alarm or a valid alarm, and transmit the status signal indicative of whether the combination represents the false alarm or the valid alarm to the automated dispatcher module. Then, the automated dispatcher module can use the status signal to automatically determine whether to alert the user and/or the relevant authorities about the alarm signal.

In some embodiments, all or parts of the automated dispatcher module can be co-located with the learning module on a cloud server and/or a control panel of the security system as either a single integrated processing module or multiple distinct processing modules. However, in some embodiments, all or parts of the automated dispatcher module and the learning module can be located on separate components that are in communication with each other. For example, all or parts of the learning module can be located on the control panel, and all or parts of the automated dispatcher module can be located on the cloud server. Similarly, all or parts of the learning module can be located on the cloud server, and all or parts of the automated dispatcher module can be located on the control panel, or all or parts of the learning module can be located on the cloud server, and all or parts of the automated dispatcher module can be located on another server that is separate and distinct from the cloud server and the control panel.

In any embodiment, each of the automated dispatcher module and the learning module can include a respective transceiver device and a respective memory device, each of which can be in communication with respective control circuitry, one or more respective programmable processors, and respective executable control software as would be understood by one of ordinary skill in the art. In some embodiments, the respective executable control software of each of the automated dispatcher module and the learning module can be stored on a transitory or non-transitory computer readable medium, including, but not limited to local computer memory, RAM, optical storage media, magnetic storage media, flash memory, and the like, and some or all of the respective control circuitry, the respective programmable processors, and the respective executable control software of each of the automated dispatcher module and the learning module can execute and control at least some of the methods described herein.

In accordance with disclosed embodiments, the security system can protect a geographic area, and in some embodiments, the additional information can include weather data from a time associated with the alarm signal, movement data associated with the geographic area during the time associated with the alarm signal, a location of users of the security system during the time associated with the alarm signal, and/or incident reports relevant to the geographic area.

In some embodiments, the learning module can transmit an identification of the security system to the automated dispatcher module with the status signal, and responsive to receiving the status signal, the automated dispatcher module can identify and execute a customized response protocol associated with the security system. Then, the automated dispatcher module can determine whether a response to executing the customized response protocol is indicative of the false alarm or the valid alarm to automatically determine whether to alert authorities about the alarm signal. For example, in some embodiments, the customized response protocol can include identifying one or more devices associated with the security system, such as a mobile device of the user, and transmitting a notification signal indicative of the alarm signal to those devices. In such embodiments, the response to executing the customized response protocol can include receiving user input indicating that the alarm signal is the false alarm or the valid alarm or failing to receive any user input. In such embodiments, the automated dispatcher module can treat failing to receive any user input as indicative of the alarm signal being the valid alarm.

In some embodiments, the learning module can build the false alarm predicting model by parsing historical data from a historical time period. For example, in some embodiments, the learning module can parse a plurality of alarm signals from the historical time period, a plurality of additional information from the historical time period, feedback signals indicative of a plurality of false alarms from the historical time period, and feedback signals indicative of a plurality of valid alarms from the historical time period to build the false alarm predicting model.

In some embodiments, the false alarm predicting model can include a global model used to assess a validity of alarms from a plurality of security systems that protect a plurality of geographic areas. In such embodiments, the plurality of alarm signals from the historical time period can originate from the plurality of security systems. With the global model, in some embodiments, the plurality of additional information from the historical time period can include the weather data from the time associated with one of the plurality of alarm signals from the historical time period, the movement data associated with one of the plurality of geographic areas during the time associated with the one of the plurality of alarm signals from the historical time period, the location of the users of one of the plurality of security systems during the time associated with the one of the plurality of alarm signals from the historical time period, and/or the incident reports relevant to one of the plurality of geographic areas.

Additionally or alternatively, in some embodiments, the false alarm predicting model can include a local model used to assess the validity of alarms from a single security system that protects a single geographic area. In such embodiments, the plurality of alarm signals from the historical time period can originate from the single security system. With the local model, in some embodiments, the plurality of additional information from the historical time period can include the weather data from the time associated with one of the plurality of alarm signals from the historical time period, the movement data associated with the single geographic area during the time associated with the one of the plurality of alarm signals from the historical time period, the location of the users of the single security system during the time associated with the one of the plurality of alarm signals from the historical time period, and/or the incident reports relevant to the single geographic area. However, with the local model, in some embodiments, the plurality of alarm signals from the historical time period can originate from the plurality of security systems as described in connection with the global model to initially build the local model, and in these embodiments, the local model can be updated based on events related to only the single security system.

In some embodiments, the user can define specific parameters that are used to build the local model. For example, in some embodiments, the user can define a length of the historical time period from which the plurality of alarm signals are used to build the false alarm predicting model. Additionally or alternatively, in some embodiments, the user can specify other customized parameters that limit which of the plurality of alarm signals from the historical time period are used to build the false alarm predicting model. For example, the other customized parameters can include a defined geographic area, a type of the plurality of alarm signals, or other parameters that can limit which of the plurality of alarm signals from the historical time period are used to build the false alarm predicting model. In embodiments in which the other customized parameters include the defined geographic area, the plurality of alarm signals from the historical time period used to build the false alarm predicting model can include only those of the plurality of alarm signals that occurred within the defined geographic area. Similarly, in embodiments in which the other customized parameters include the type of the plurality of alarm signals, the plurality of alarm signals from the historical time period used to build the false alarm predicting model can include only those of the plurality of alarm signals that match the type, for example, a window alarm signal or a door alarm signal.

Additionally or alternatively, in some embodiments, the learning module can build the false alarm predicting model by recognizing patterns in the historical data. For example, in some embodiments, the learning module can identify first patterns of the plurality of alarm signals from the historical time period and the plurality of additional information from the historical time period that result in the feedback signals indicative of the plurality of false alarms from the historical time period. Similarly, the learning module can recognize second patterns of the plurality of alarm signals from the historical time period and the plurality of additional information from the historical time period that result in the feedback signals indicative of the plurality of valid alarms from the historical time period. Then, in operation, the learning module can compare the combination of the alarm signal and the additional information to the first patterns and the second patterns to determine whether the combination represents the false alarm or the valid alarm.

Furthermore, in some embodiments, the learning module can update the false alarm predicting model for increased accuracy at future times. For example, in some embodiments, the learning module can receive feedback signals indicating whether the combination of the alarm signal and the additional information represents the false alarm or the valid alarm and can use those feedback signals to update the false alarm predicting model for the increased accuracy at the future times.

In some embodiments, any of the feedback signals described herein can include user input explicitly identifying the alarm signal or the plurality of alarm signals from the historical time period as the valid alarm or the false alarm. Additionally or alternatively, in some embodiments, any of the feedback signals described herein can include information related to actions executed in response to the alarm signal or the plurality of alarm signals from the historical time period that are indicative of the valid alarm or the false alarm.

For example, in some embodiments, the information related to the actions executed that are indicative of the false alarm can include a dispatcher of a central monitoring station refraining from notifying the authorities about the alarm signal or the plurality of alarm signals from the historical time period or a report from the authorities identifying the false alarm after surveying the geographic area associated with the security system from which the alarm signal or the plurality of alarm signals from the historical time period originated. For example, the report from the authorities identifying the false alarm can include a description of the authorities walking around the geographic area and identifying nothing unusual or identifying a window or a door being open because of weather, not any presence of an intruder. Similarly, in some embodiments, the information related to the actions executed that are indicative of the valid alarm can include the dispatcher of the central monitoring station notifying the authorities about the alarm signal or the plurality of alarm signals from the historical time period or a report from the authorities identifying the valid alarm after surveying the geographic area associated with the security system from which the alarm signal or the plurality of alarm signals from the historical time period originated.

The learning module can receive the information related to the actions executed that are indicative of the false alarm or the valid alarm in a variety of ways. For example, in some embodiments, the learning module can automatically receive and parse the information related to the actions executed that are indicative of the false alarm or the valid alarm directly or via another module. Additionally or alternatively, in some embodiments, the learning module can manually receive the information related to the actions executed that are indicative of the false alarm or the valid alarm from an operator of the central monitoring station, from the user, or the relevant authorities.

In some embodiments, the learning module can identify a score to determine whether the combination of the alarm signal and the additional information represents the false alarm or the valid alarm. For example, the score can be indicative of a likelihood or a probability that the combination represents the false alarm or the valid alarm. In some embodiments, the score can be based on an amount by which the alarm signal and the additional information match the plurality of alarm signals from the historical time period and the plurality of additional information from the historical time period, and in some embodiments, the alarm signal and/or the additional information can be automatically or manually assigned different weights for such a matching comparison. Furthermore, the learning module can transmit the score to the automated dispatcher module, for example, with the status signal. Then, the automated dispatcher module can compare the score to a threshold value to automatically determine whether to alert the user and/or the relevant authorities about the alarm signal. When such a comparison and/or the score indicates that the automated dispatcher module should alert the user and/or the relevant authorities, the automated dispatcher module can automatically alert the user and/or the relevant authorities about the alarm signal without human intervention.

In some embodiments, the score can include a simple numerical value that can be deciphered by a human user as indicating that the combination of the alarm signal and the additional information represents the false alarm or the valid alarm. However, in some embodiments, the score can include a range of values with a calculated distribution (e.g. Gaussian) that indicates whether the combination of the alarm signal and the additional information represents the false alarm or the valid alarm. In such embodiments, the automated dispatcher module can include a cumulative distribution function that indicates when the automated dispatcher module should alert the user and/or the authorities, and in some embodiments, a sensitivity of the automated dispatcher module to the score can be automatically or manually adjusted based on the user preference data, such as days of the week or when the user is out of town.

Additionally or alternatively, in some embodiments, the learning module can make a binary determination as to whether the combination of the alarm signal and the additional information represents the false alarm or the valid alarm and transmit the binary determination to the automated dispatcher module with the status signal. In such embodiments, when the binary determination indicates that the combination represents the valid alarm, the automated dispatcher module can automatically alert the user and/or the relevant authorities about the alarm signal without human intervention.

Various embodiments for how the automated dispatcher module can alert the user and/or the relevant authorities are contemplated. For example, in some embodiments, the automated dispatcher module can insert the notification signal indicative of the alarm signal and demographic data associated with the alarm signal directly into a dispatch system for the relevant authorities. In some embodiments, some or all of the demographic data can be retrieved from a database of the cloud server using an identifier of the security system that sent the alarm signal to the cloud server. Additionally or alternatively, in some embodiments, some or all of the demographic data can be received from the security system with the alarm signal.

Additionally or alternatively, in some embodiments, the automated dispatcher module can call the user and/or the relevant authorities using voice emulation systems to report the alarm signal. Additionally or alternatively, in some embodiments, the automated dispatcher module can transmit an instruction signal to the mobile device of the user with instructions to contact the relevant authorities.

In some embodiments, the learning module can also transmit the status signal to a central monitoring station for processing thereof. For example, in some embodiments, the status signal can include the score that is indicative of the likelihood or the probability that the combination of the alarm signal and the additional information represents the false alarm or the valid alarm, and the central monitoring station can use the score to process and prioritize the alarm signal. For example, in some embodiments, when the score is indicative of a high likelihood of the alarm signal being the false alarm, the central monitoring station can deprioritize the alarm signal by, for example, placing the alarm signal at an end of a queue behind other alarm signals more likely to be valid. Additionally or alternatively, in some embodiments, a sensitivity of the central monitoring station to the score can be automatically or manually adjusted based on a price or level of service that the central monitoring station provides to the user.

Additionally or alternatively, in some embodiments, the learning module can transmit the alarm signal to the central monitoring station for processing thereof only when the status signal is indicative of a high likelihood of the alarm signal being the valid alarm. For example, in embodiments in which the learning module identifies the score that is indicative of the likelihood or the probability that the combination represents the false alarm or the valid alarm, the learning module can transmit the alarm signal to the central monitoring station when the score meets or exceeds the threshold value. However, in embodiments in which the learning module outputs the binary determination as to whether the combination of the alarm signal and the additional information represents the false alarm or the valid alarm, the learning module can transmit the alarm signal to the central monitoring station when the binary determination indicates that the alarm signal is the valid alarm.

FIG. 1, FIG. 2, FIG. 3, FIG. 4, and FIG. 5 are block diagrams of systems 20A, 20B, 20C, 20D, 20E in accordance with disclosed embodiments. As seen in FIG. 1, FIG. 2, FIG. 3, FIG. 4, and FIG. 5, the systems 20A, 20B, 20C, 20D, 20E can include a learning module 24, an automated dispatcher module 26, a security system 28 that protects a region R, a user device 30 associated with the security system 28, an external information source 32, and a dispatch system 34. As further seen in FIG. 1, FIG. 2, FIG. 3, FIG. 4, and FIG. 5, the user device 30 and the external information source 32 can communicate with the learning module 24, and the automated dispatcher module 26 can communicate with the dispatch system 34. In some embodiments, the user device 30 can include a mobile device of a user of the security system 28, and in some embodiments, the external information source 32 can include a weather service, an emergency services database, and the like.

In some embodiments, each of the learning module 24 and the automated dispatcher module 26 can include a respective transceiver device and a respective memory device in communication with respective control circuitry, one or more respective programmable processors, and respective executable control software as would be understood by one of ordinary skill in the art. In some embodiments, the respective executable control software of each of the learning module 24 and the automated dispatcher module 26 can be stored on a transitory or non-transitory computer readable medium, including, but not limited to local computer memory, RAM, optical storage media, magnetic storage media, flash memory, and the like, and some or all of the respective control circuitry, the respective programmable processors, and the respective executable control software of each of the learning module 24 and the automated dispatcher module 26 can execute and control at least some of the methods described herein.

Figure 2:
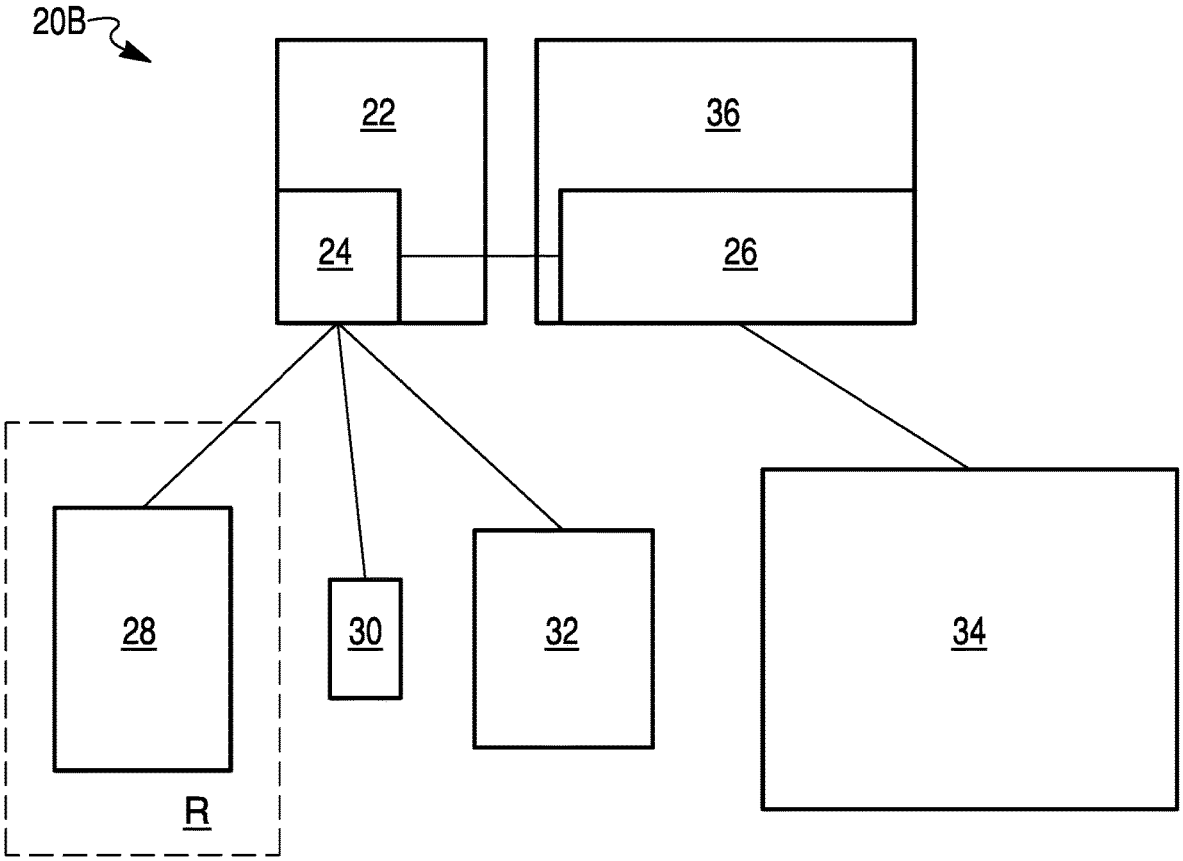
FIG. 2 is a block diagram of a system in accordance with disclosed embodiments.
Figure 3:
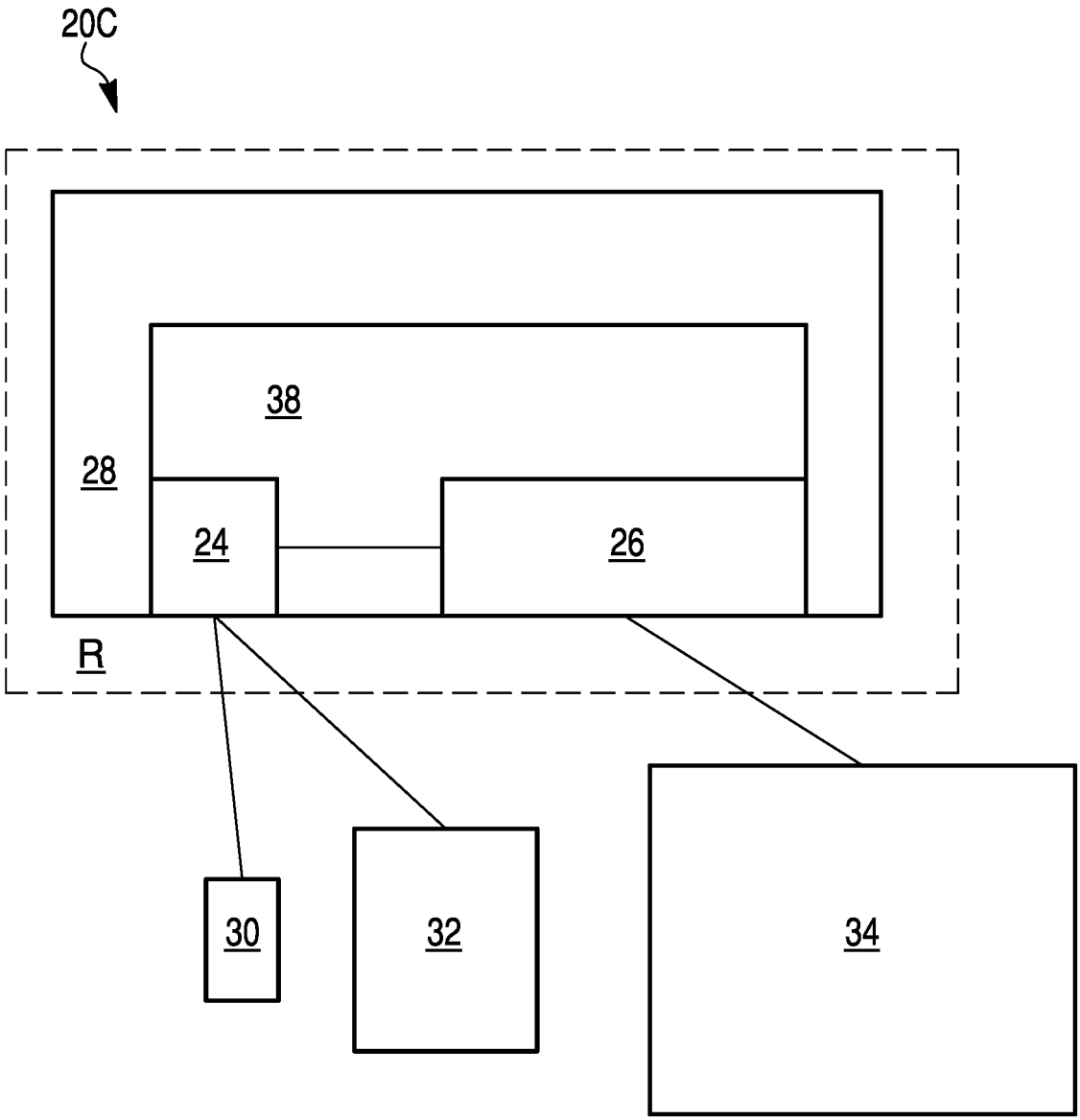
FIG. 3 is a block diagram of a system in accordance with disclosed embodiments.
Figure 4:
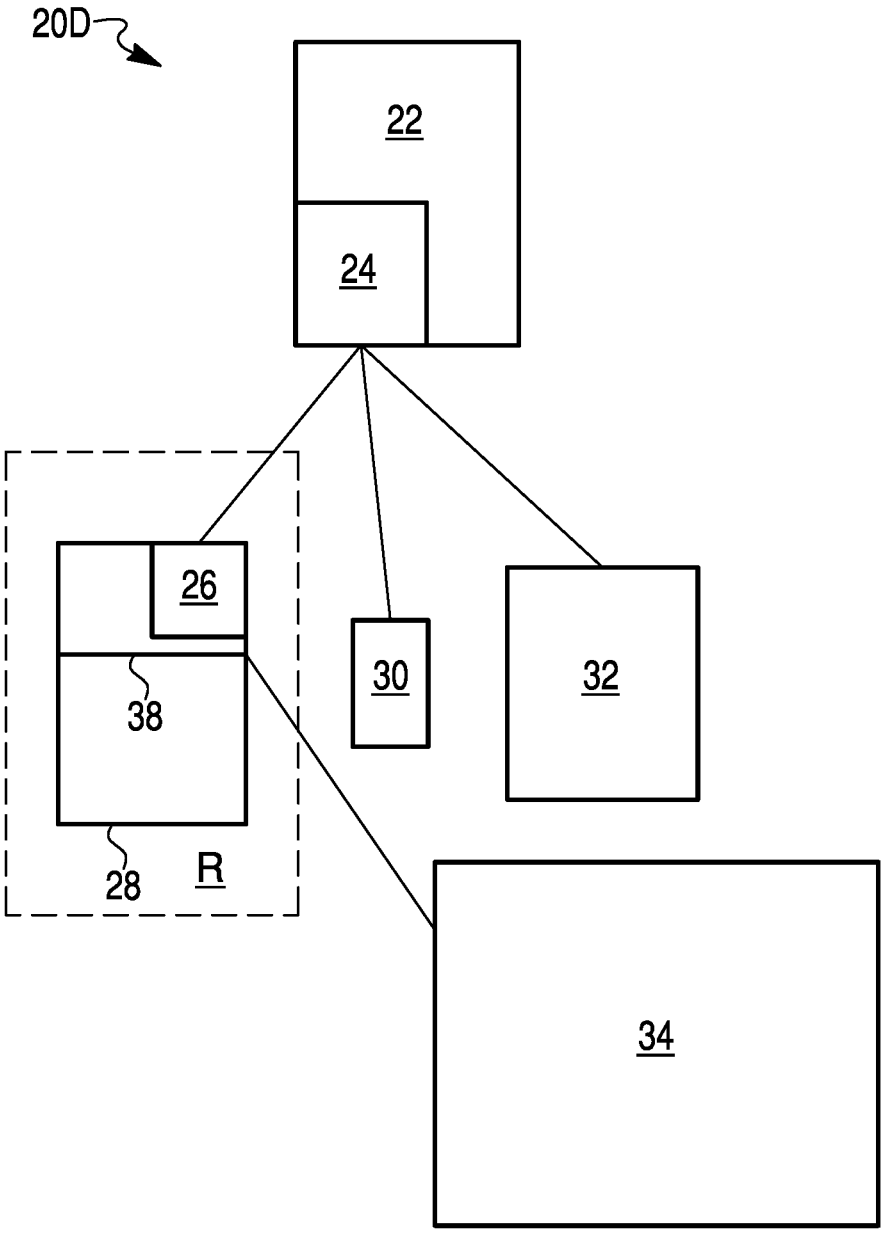
FIG. 4 is a block diagram of a system in accordance with disclosed embodiments.
Figure 5:
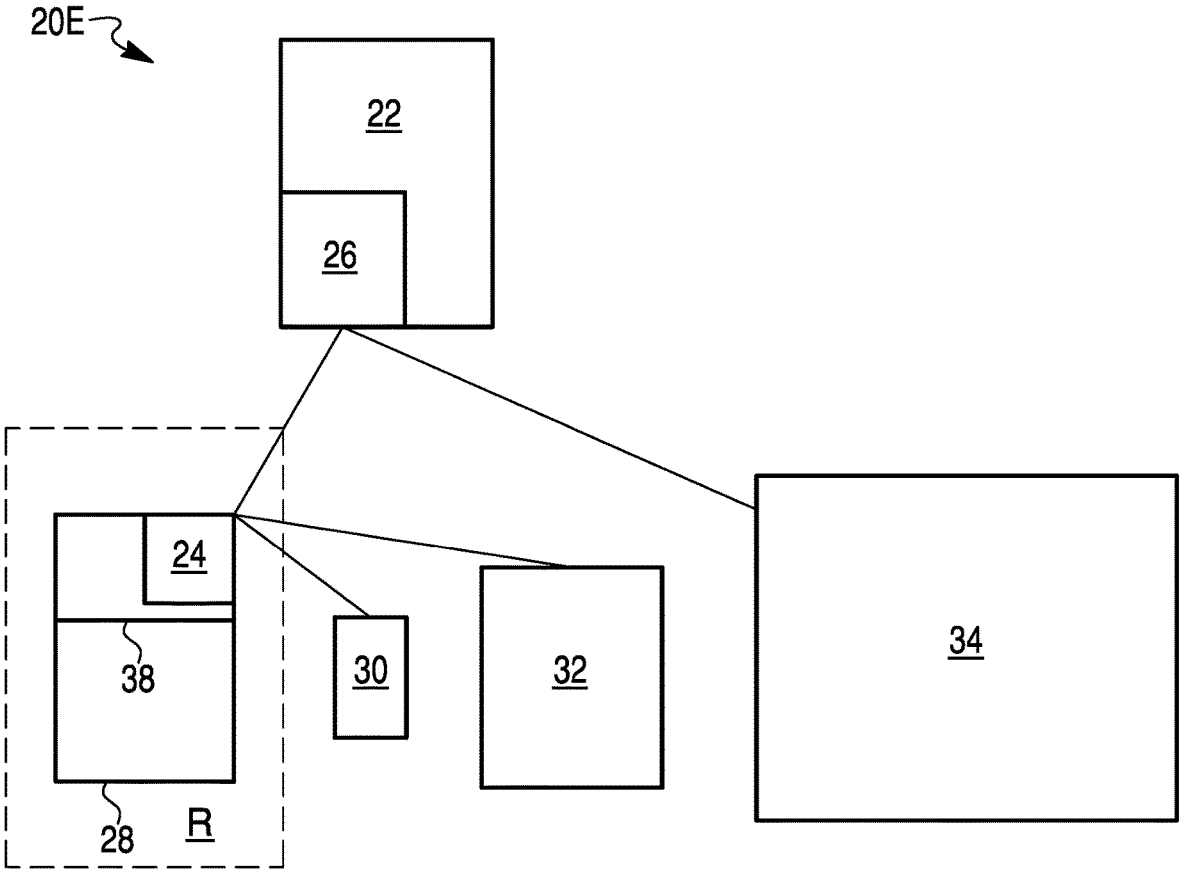
FIG. 5 is a block diagram of a system in accordance with disclosed embodiments.

As seen in FIG. 1, in some embodiments, both the learning module 24 and the automated dispatcher module 26 can be located on or be part of a cloud server 22. However, as seen in FIG. 2, in some embodiments, the automated dispatcher module 26 can be located on or be part of another server 36. Alternatively, as seen in FIG. 3, in some embodiments, both the learning module 24 and the automated dispatcher module 26 can be located on or be part of a control panel 22. However, as seen in FIG. 4, in some embodiments, the learning module 24 can be located or be part of the cloud server 22, and the automated dispatcher module 26 can be located on or be part of the control panel 38. Conversely, as seen in FIG. 5, in some embodiments, the automated dispatcher module 26 can be located on or be part of the cloud server 22, and the learning module 24 can be located on or be part of the control panel 38.

Figure 6:
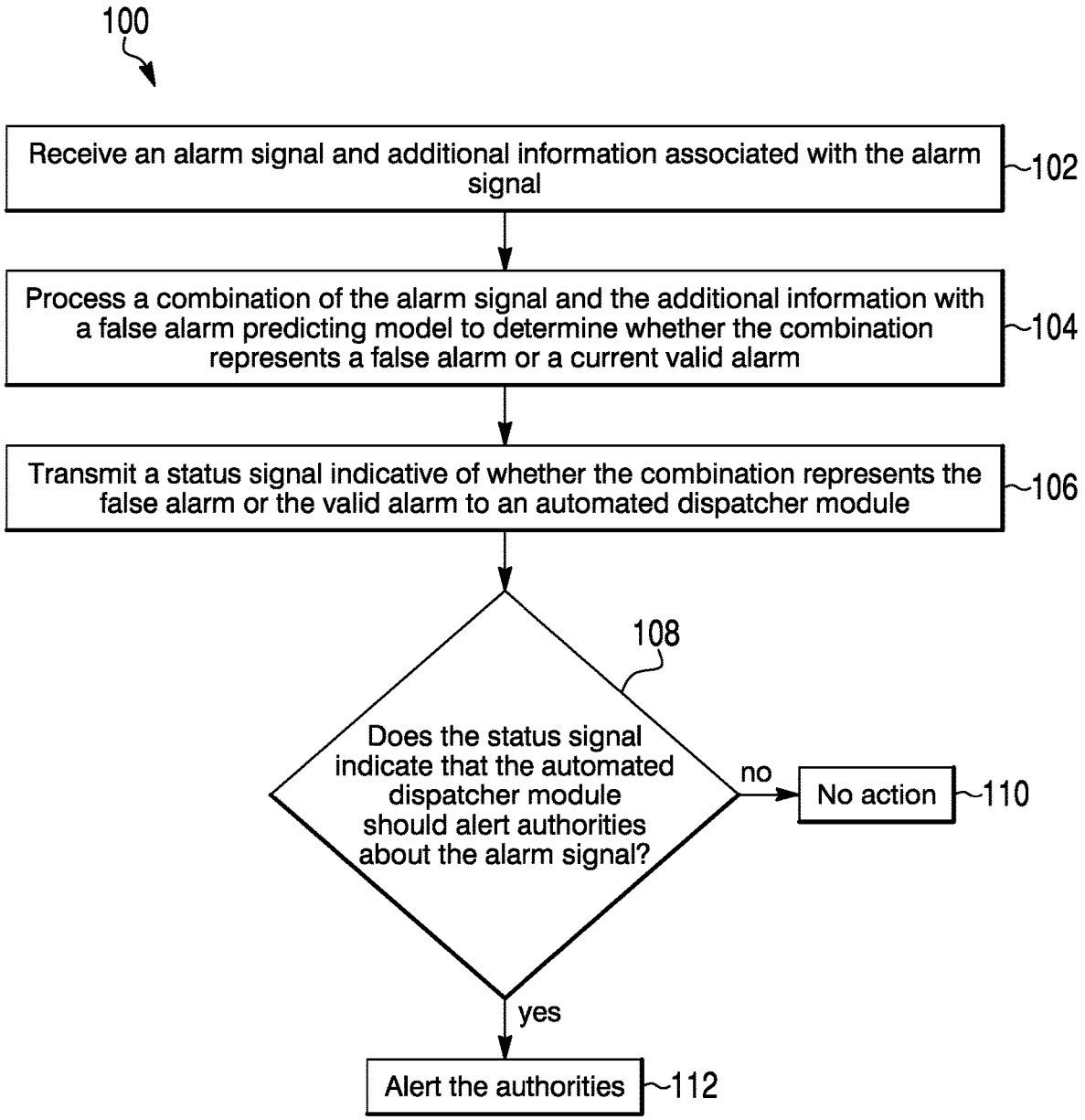
FIG. 6 is a flow diagram of a method in accordance with disclosed embodiments.

FIG. 6 is a flow diagram of a method 100 in accordance with disclosed embodiments. As seen in FIG. 6, the method 100 can include the learning module 24 receiving an alarm signal from the security system 28 and receiving additional information associated with the alarm signal from the security system 28 and/or from the external information source 32, as in 102. Then, the method 100 can include the learning module 24 using a false alarm predicting model to process a combination of the alarm signal and the additional information to determine whether the combination represents a false alarm or a valid alarm, as in 104, and transmitting a status signal indicative of whether the combination represents the false alarm or the valid alarm to the automated dispatcher module 26, as in 106.

After receiving the status signal, the method 100 can include the automated dispatcher module 26 determining whether the status signal indicates that the automated dispatcher module 26 should alert the user and/or relevant authorities about the alarm signal, as in 108. When the status signal fails to indicate that the automated dispatcher module 26 should alert the user and/or the relevant authorities, the method 100 can include taking no further action, as in 110. However, when the status signal indicates that the automated dispatcher module 26 should alert the user and/or the relevant authorities, the method 100 can include the automated dispatcher module 26 initiating an appropriate action as in 112, for example, by alerting the relevant authorities by inserting a notification signal indicative of the alarm signal and demographic data associated with the alarm signal directly into the dispatch system 34.

Although a few embodiments have been described in detail above, other modifications are possible. For example, the logic flows described above do not require the particular order described or sequential order to achieve desirable results. Other steps may be provided, steps may be eliminated from the described flows, and other components may be added to or removed from the described systems. Other embodiments may be within the scope of the invention.

From the foregoing, it will be observed that numerous variations and modifications may be effected without departing from the spirit and scope of the invention. It is to be understood that no limitation with respect to the specific system or method described herein is intended or should be inferred. It is, of course, intended to cover all such modifications as fall within the spirit and scope of the invention.

What is claimed is:

1. A method comprising:

receiving an alarm signal from a security system;

processing a combination of the alarm signal and additional information associated with the alarm signal to determine whether the combination represents a valid alarm or a false alarm;

identifying a customized response protocol associated with the security system;

executing the customized response protocol;

responsive to determining that (1) the combination represents the valid alarm and (2) a response to executing the customized response protocol is indicative of the valid alarm, transmitting a first signal indicative of the valid alarm; and responsive to determining that (1) the combination represents the false alarm and (2) the response to executing the customized response protocol is indicative of the false alarm, transmitting a second signal indicative of the false alarm or refraining from transmitting any status signal.

2. The method of claim 1 wherein executing the customized response protocol includes transmitting a notification signal to a mobile device associated with the security system.

3. The method of claim 2 wherein the response to executing the customized response protocol that is indicative of the valid alarm includes receiving user input identifying the alarm signal as the valid alarm.

4. The method of claim 2 wherein the response to executing the customized response protocol that is indicative of the valid alarm includes a feedback signal identifying an executed user action that is indicative of the valid alarm.

5. The method of claim 2 wherein the response to executing the customized response protocol that is indicative of the valid alarm includes receiving no user input for a predetermined period of time responsive to the notification signal.

6. The method of claim 2 wherein the response to executing the customized response protocol that is indicative of the false alarm includes receiving user input identifying the alarm signal as the false alarm.

7. The method of claim 2 wherein the response to executing the customized response protocol that is indicative of the false alarm includes a feedback signal identifying an executed user action that is indicative of the false alarm.

8. A method comprising:

receiving a first alarm signal from a first security system;

using a false alarm predicting model to process a combination of the first alarm signal and first additional information associated with the first alarm signal to determine whether the combination represents a valid alarm or a false alarm;

responsive to determining that the combination represents the valid alarm, transmitting a first signal indicative of the valid alarm; and responsive to determining that the combination represents the false alarm, transmitting a second status signal indicative of the false alarm or refraining from transmitting any status signal, wherein the false alarm predicting model is built from a plurality of other alarm signals from a historical time period and a plurality of other additional information from the historical time period.

9. The method of claim 8 wherein the plurality of other alarm signals originate from a plurality of other security systems.

10. The method of claim 9 wherein the plurality of other additional information relates to the plurality of other security systems or a respective geographic region protected by each of the plurality of other security systems.

11. The method of claim 8 wherein the plurality of other alarm signals originate from the first security system.

12. The method of claim 8 wherein the plurality of other alarm signals originate from a plurality of other security systems, wherein the false alarm predicting model is updated with a plurality of additional alarm signals, and wherein the plurality of additional alarm signals originate from the first security system.

13. The method of claim 8 wherein user-defined parameters define or limit the plurality of other alarm signals, the historical time period, or the plurality of additional information.

14. The method of claim 8 wherein the false alarm predicting model is built from recognized patterns in the plurality of other alarm signals and the plurality of other additional information.

15. The method of claim 14 further comprising:

comparing the combination to the recognized patterns to determine whether the combination represents the valid alarm or the false alarm.

16. The method of claim 8 further comprising:

receiving a feedback signal indicating whether the combination represents the valid alarm or the false alarm; and updating the false alarm predicting model for increased accuracy.

17. A system comprising:

a transceiver device; and a programmable processor, wherein the transceiver device receives a first alarm signal from a first security system, wherein the programmable processor uses a false alarm predicting model to process a combination of the alarm signal and first additional information associated with the first alarm signal to determine whether the combination represents a valid alarm or a false alarm;

wherein the programmable processor identifies a customized response protocol associated with the security system, wherein the transceiver device and the programmable processor execute the customized response protocol, wherein, responsive to determining that (1) the combination represents the valid alarm and (2) a response to executing the customized response protocol is indicative of the valid alarm, the transceiver device transmits a first signal indicative of the valid alarm, wherein, responsive to determining that (1) the combination represents the false alarm and (2) the response to executing the customized response protocol is indicative of the false alarm, the transceiver device transmits a second signal indicative of the false alarm or refrains from transmitting any status signal, and wherein the false alarm predicting model is built from a plurality of other alarm signals from a historical time period and a plurality of other additional information from the historical time period.

18. The system of claim 17 wherein executing the customized response protocol includes the programmable processor identifying a mobile device associated with the security system and the transceiver device transmitting a notification signal to the mobile device.

19. The system of claim 17 wherein the plurality of other alarm signals originate from a plurality of other security systems.

20. The system of claim 17 wherein the plurality of other alarm signals originate from the first security system.

* * * * *